US010189275B2

(12) United States Patent
Schach et al.

(10) Patent No.: US 10,189,275 B2
(45) Date of Patent: Jan. 29, 2019

(54) TREATMENT SEGMENT WITH A COUPLING SECTION AND DEVICE FOR PRINTING CONTAINERS

(71) Applicant: KHS GmbH, Dortmund (DE)

(72) Inventors: Martin Schach, Bochum (DE); Markus Reiniger, Mönchengladbach (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 15/570,819

(22) PCT Filed: May 24, 2017

(86) PCT No.: PCT/EP2017/062684
§ 371 (c)(1),
(2) Date: Oct. 31, 2017

(87) PCT Pub. No.: WO2017/207409
PCT Pub. Date: Dec. 7, 2017

(65) Prior Publication Data

US 2018/0222213 A1 Aug. 9, 2018

(30) Foreign Application Priority Data

May 30, 2016 (DE) ..... 10 2016 109 895

(51) Int. Cl.
*B41J 3/407* (2006.01)
*B65B 61/26* (2006.01)
(Continued)

(52) U.S. Cl.
CPC ..... *B41J 3/4073* (2013.01); *B65B 61/26* (2013.01); *B65C 9/0062* (2013.01); *B65C 9/04* (2013.01); *B67C 3/24* (2013.01)

(58) Field of Classification Search
CPC ..... B41J 3/407; B41J 3/4073; B41J 11/0015; B65B 61/25; B65B 61/26; B65B 67/02;
(Continued)

(56) References Cited

U.S. PATENT DOCUMENTS 4,318,703 A * 3/1982 Richards ..... B31B 50/00 493/149
7,980,046 B2 * 7/2011 Yousefpour ..... B08B 3/02 53/167
(Continued)

FOREIGN PATENT DOCUMENTS

DE 10 2007 050 490 4/2009
DE 10 2010 020 958 11/2011
(Continued)

*Primary Examiner* — Anh T. N. Vo
(74) *Attorney, Agent, or Firm* — Occhiuti & Rohlicek LLP

(57) ABSTRACT

A treatment segment for printing on containers includes a coupling section for securing the treatment segment on a revolving and drivable transport element such that the treatment segment can be exchanged. The treatment segment has either a retention-and-centering unit for securing a container on the treatment segment or a receiver for retaining and releasing a retention-and-centering unit. The coupling section is a component of a support structure that runs, at least in sections, in an interior of the treatment segment enclosed by a housing. The housing is retained, at least indirectly, on the support structure.

28 Claims, 6 Drawing Sheets

(51) Int. Cl.
*B65C 9/00* (2006.01)
*B65C 9/04* (2006.01)
*B67C 3/24* (2006.01)

(58) Field of Classification Search
CPC .... B65C 9/00; B65C 9/04; B67C 3/24; B65G 47/84; B65G 2201/0244; B65G 2201/0252
See application file for complete search history.

(56) References Cited

U.S. PATENT DOCUMENTS

| | | | | |
|---|---|---|---|---|
| 8,356,461 | B2 * | 1/2013 | Cedrone | B67C 7/0033 53/284.5 |
| 2018/0001624 | A1 * | 1/2018 | Koers | B41J 3/4073 |

FOREIGN PATENT DOCUMENTS

| | | |
|---|---|---|
| DE | 10 2011 112106 | 2/2013 |
| DE | 10 2013 217202 | 3/2015 |
| EP | 2 792 603 | 10/2014 |
| WO | WO 2012/077147 | 6/2012 |
| WO | WO 2013/029711 | 3/2013 |

* cited by examiner

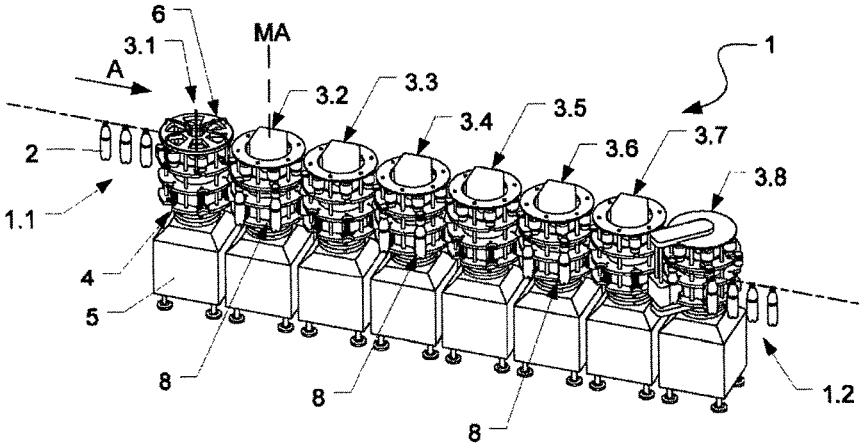
Fig. 1
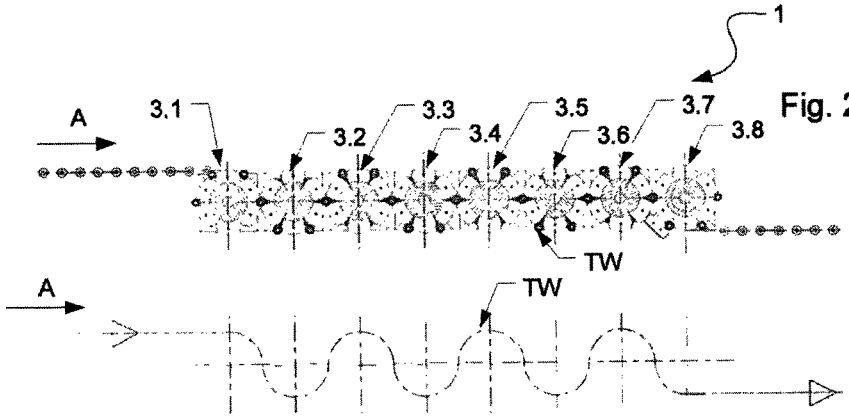
Fig. 2a
Fig. 2b

TREATMENT SEGMENT WITH A COUPLING SECTION AND DEVICE FOR PRINTING CONTAINERS

RELATED APPLICATIONS

This application is the national stage of international application PCT/EP2017/062684, filed May 24, 2017, which claims the benefit of the priority date of German application DE102016109895, filed May 30, 2016, the contents of which are herein incorporated by reference.

FIELD OF INVENTION

The invention relates to a treatment segment and a device for printing on containers.

BACKGROUND

Known printing systems for printing on containers have printing stations formed on a driven transport element that rotates about at least one vertical axis for receiving a container that is to be printed on. In these known devices, the container is printed on using an inkjet printer.

A typical printing machine includes transport elements directly adjoining one another in the transport direction. Some of the transport elements function as treatment units for the printing. These treatment units each apply one color of the printed image. Each treatment unit has fully functioning treatment modules or treatment segments that can be swapped in and out of the transport element.

Known treatment segments have a housing to which a print head can be attached. This housing must be constructed with great precision to permit precise transferring of a container between the individual transport elements.

SUMMARY

An object of the invention is to provide a treatment segment that can be produced inexpensively with high precision.

According to a first aspect, the invention relates to a treatment segment for printing on containers. The treatment segment comprises a coupling section by means of which the treatment segment can be secured to a revolving drivable transport element such that it can be swapped in and out. The treatment segment also has either a retention-and-centering unit for securing the container on the treatment segment or a receiver for retaining and releasing such a retention-and-centering unit. The coupling section of the treatment segment is a component of a support structure that runs at least in sections in an interior of the treatment segment enclosed by a housing. The housing itself is at least indirectly retained on this support structure.

A substantial advantage of the treatment segment is that the housing no longer has to be made with high precision. Only the central supporting support structure, which is what supports the functional components, has to be made with high precision. The housing can also be attached to this central support structure.

In other words, the housing no longer forms the connection to the transport element. Instead, the support structure forms the support element of the treatment segment. It is therefore the support structure through which the treatment segment is retained in an aligned position on the transport element. As a result, the production costs for the treatment segment can be significantly reduced.

According to an exemplary embodiment, the support structure has at least one first coupling-element on which two spaced apart bearing sections are formed. The bearing sections can be formed through milling on a first coupling-element composed of a solid material. By way of example, the bearing sections each have pairs of bearing surfaces that are formed such that an alignment of the treatment segment in relation to the transport element takes place in two orthogonal spatial directions through these bearing surfaces. This promotes exact alignment of the treatment segment on the transport element.

According to one exemplary embodiment, the bearing sections are angular. In some embodiments, the bearing sections are formed to encompass an edge of a support section provided on the transport element. Among these are embodiments in which it encompasses a support rim, is encompassed. This further improves alignment of the treatment segment on the transport element.

In yet another embodiment, the bearing sections each have a planar first bearing-surface and a second bearing surface that projects downward at an angle therefrom. The first bearing surface can be horizontal or substantially horizontal such that it bears on a bearing region provided on an upper surface of the support section, and in particular on a support rim. The second bearing-surface of the bearing section can be provided such that it bears on a front-surface bearing-region of the support section, in particular the support rim. In some of these embodiments, the bearing sections join the support section from above. This promotes exact alignment of the treatment segment.

Embodiments include those in which the second bearing surface is planar and those in which it is concave. A planar second bearing surface is particularly useful when the front-surface bearing-region of the support section, or the support rim, of the support element is likewise planar. A curved, and in particular a concave design is advantageous when the front surface of the support section, or the support rim, has a convex curvature.

According to one exemplary embodiment, the first coupling-element has a connecting section provided between the bearing sections. This connecting section is useful for preventing lateral displacement or removal of the treatment segment in the radial direction with respect to the rotational axis of the transport element.

According to one exemplary embodiment, the connecting section is a bolt. In particular, connecting section's longitudinal axis is vertically aligned. The treatment segment can be hung in a corresponding borehole in the support section or the support rim by means of the connecting section. After it has been hung in place, the bearing sections provided on both sides of the connecting section bear on an edge of the support section or the support rim, on top and at the ends. This results in a precise and stable placement of the treatment segment on the transport element.

According to one exemplary embodiment, the coupling section is configured for a hanging retention of the treatment segment. The coupling section of the treatment segment can be placed on the support section or the support rim from above. This retains the support structure of the treatment segment, and thus the entire treatment segment, in a stable and precise manner on the transport element.

According to another exemplary embodiment, a plate-shaped element forms the first coupling-element. The plate-shaped element can exhibit the bearing section on a back region, and extend through a back housing wall into the interior of the treatment segment. This section of the coupling element that extends into the interior then provides a place for direct or indirect attachment of equipment necessary for treating the containers.

According to yet another exemplary embodiment, the first coupling-element is aligned in the treatment segment such that the vertical axis of the treatment segment is perpendicular to the first coupling-element. In other words, the first coupling-element runs in the horizontal plane, or substantially in the horizontal plane, when the vertical axis of the treatment segment is vertical.

In still other embodiments, the first coupling-element is provided in the upper half, and preferably in the upper third, of the treatment segment. As a result, the elongated treatment segment can be disposed precisely on the transport element in an upper region, and the first coupling-element can furthermore serve as an anchoring element for securing functional elements in this region.

Among the embodiments are those in which the support structure has a component carrier that protrudes downward from the first coupling-element. This component carrier can be formed from a solid material, such as a solid piece of metal. The component carrier is useful for attaching equipment necessary for the treatment of the containers. These would include, for example, functional components such as a print head or a retention device. The first coupling-element and the component carrier preferably form a T-shaped structure when viewed from above.

In some embodiments, a second coupling-element is spaced apart from the first coupling-element. The second coupling-element interacts with a further support section or support rim provided on the transport element such that the support structure is secured to the transport element at two regions that are spaced apart.

According to one exemplary embodiment, the second coupling-element connects to the first coupling-element via the component carrier. The component carrier preferably runs in the manner of a web between the first and second coupling-elements so as to form, on the whole, a double T-shaped fundamental structure for the support structure. As a result, the support structure has a structure in which the material has been reduced as much as possible, while retaining a high stability, such that the number of components that must be very precisely formed is substantially reduced.

According to one exemplary embodiment, the second coupling-element has at least one, preferably a pair of, bolt-like connecting sections. A plug-in connection can be produced by means of this bolt-like connecting section between the second coupling-element and the support structure and the support section/support rim of the transport element. There are preferably no other sections provided on the second coupling-element, other than the at least one bolt-like connecting section, lying opposite the support section/support rim of the transport element. In a region spaced apart from the first coupling-element of the treatment segment, the treatment segment can be secured to the transport element by means of the bolt-like connecting section, by means of which the attachment stability of the treatment segment is improved.

According to one exemplary embodiment, damping elements are provided on the bolt-like connecting sections of the second coupling-element. By way of example, the damping elements can encompass an upper part of the connecting sections on the circumference thereof. At the undersurface, the connecting sections protrude opposite the damping elements, such that these protruding sections can be inserted into corresponding boreholes of the support section/support rim. The damping sections end up between the second coupling-element and the support section/support rim, such that it is possible to dampen impacts by this means. The damping elements can be made of any elastic material, in particular rubber, or they can contain rubber.

According to one exemplary embodiment, the retention-and-centering unit, or the receiver for the retention-and-centering unit is disposed directly on the first coupling-element. As a result, impacts to the retention-and-centering unit, or the receiver for the retention-and-centering unit, e.g. through placing the retention-and-centering unit into the corresponding receiver, can be diverted directly into the transport element, and thus the resulting vibrations can be decisively reduced.

According to one exemplary embodiment, the housing has a louver for closing off, at least in part, a component receiving region. As a result, open or hollow spaces can be eliminated in the treatment segments, which would lead to significant air turbulences when the transport element rotates. Such air turbulences have a negative effect on the printing quality, because the droplets of ink emitted from the print heads are deflected.

According to one exemplary embodiment, the treatment segment has a near-field communication interface, in particular an infrared interface, for data exchange between two treatment segments with their front surfaces lying opposite one another. As a result, data can be exchanged between the respective treatment segments, in particular at a point in time in which these lie opposite one another at their front surfaces.

According to a further aspect, the invention relates to a device for printing on containers with a revolving drivable transport element, to which numerous printing segments can be secured, distributed over the circumference, by means of which the containers are printed. At least one support rim to which the printing segments can be attached is provided thereby on the transport element. The support rim has at least two angular support rim surfaces, in particular running orthogonal to one another, against which bearing sections of the respective print segment bear, for a precise positioning of the print segment in relation to the transport element. As a result, a precise positioning of the printing segments on the transport element can be obtained in a technologically simple manner, with low production costs.

According to one exemplary embodiment, the support rim surfaces are formed by an upper support-rim surface and a support rim surface on the front side. The bearing sections of the print segment bear at an angle in relation to the support rim, by means of which an exact placement of the printing segments on the transport element in two spatial directions is obtained.

According to one exemplary embodiment, the support rim is configured for a hanging retention of the printing segments. In particular, the printing segments can be hung on the support rim from above, such that they do not bear on the support element at the bottom. As a result, the assembly thereof is facilitated, with a higher alignment precision.

According to one exemplary embodiment, a pair of support rims is provided on the transport element, wherein the support rims are spaced apart vertically. As a result, the printing segments can be retained at two securing regions on the transport element provided at different heights, further increasing the alignment precision and improving the attachment of the printing segments.

According to one exemplary embodiment, the support rim has boreholes for receiving bolt-like connecting sections provided on the printing segments. These boreholes are preferably vertical, such that the bolt-like connecting sections of the printing segments can be inserted from above into these boreholes. As a result, assembly is facilitated in turn, with higher alignment precision.

According to one exemplary embodiment, the outer circumference of the support rim has a polygonal shape. This means that there are flat surfaces on the support rim. Each flat surface forms a receiving area for a print segment. As a result, a nearly exact alignment of the printing segments on the transport means is obtained by using the bearing sections provided on the coupling region.

As used herein, the term "treatment segment" means any segment or module by means of which a container treatment can take place. The container treatment can be, in particular, the printing on containers, drying containers that have been printed on, and inspecting containers.

As used herein, the term "support structure" means a supporting component that is used to connect the treatment segment to the transport element and results in the precise alignment thereof on the transport element. Equipment for container treatment can preferably be disposed or secured on the support structure.

As used herein, the term "housing" means any housing that at least partially encloses the treatment segment. In particular, the housing can be only partially closed.

As used herein, the term "container" refers to all containers, in particular bottles, cans, etc.

As used herein, the terms "substantially" or "approximately" indicate deviations from the respective exact value of ±10%, preferably ±5%, and/or deviations in the form of changes that are functionally insignificant.

Further developments, advantages and application possibilities of the invention can also be derived from the following description of exemplary embodiments, and from the figures. All of the features described and/or illustrated thereby are fundamentally the subject matter of the invention, in and of themselves or in arbitrary combinations thereof, independently of their summaries in the Claims or their back references. Furthermore, the contents of the Claims are to be regarded as an integral part of the description.

BRIEF DESCRIPTION OF THE DRAWINGS

The invention shall be explained in greater detail below, based on the Figures showing exemplary embodiments. Therein:

FIG. 1 shows a printer in a perspective view;

FIG. 2*a* shows a top view of the printer shown in FIG. 1;

FIG. 2*b* shows a transport pathway through the printer shown in FIG. 2*a;*

DETAILED DESCRIPTION

Figure 3:
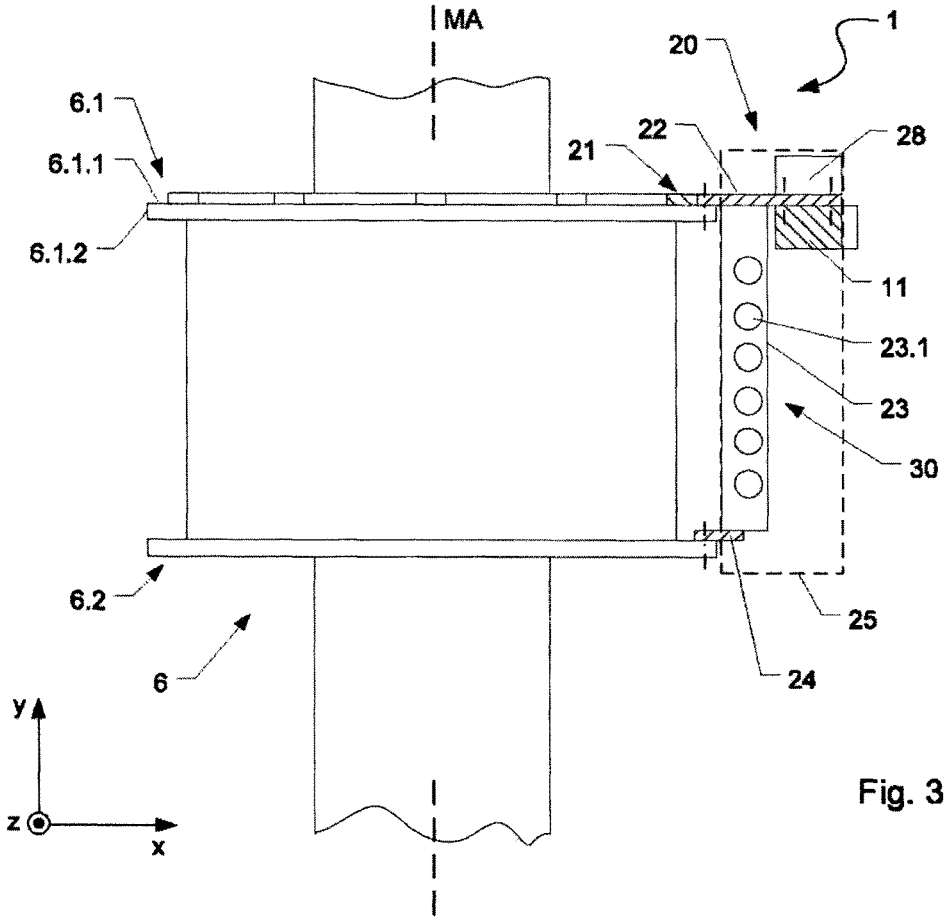
FIG. 3 shows a side view of a treatment segment disposed on a transport element from the printer shown in FIG. 1.

FIG. 1 shows a printing machine 1 for printing on containers 2, such as bottles, and in particular, for printing directly on the outer surfaces of the containers' walls or on labels applied thereto.

An external transporter transports upright containers 2 along a transport direction A to a container intake 1.1 of the printing machine 1. The containers 2 enter the printing machine 1 and traverse a serpentine transport path TW, as shown in FIGS. 2*a* and 2*b*. After having been printed upon, an external transporter feeds the upright containers 2 to a container discharge 1.2.

The printing machine 1 comprises numerous machine units 3.1-3.*n* that directly adjoin one another along the transport direction A. Each transport element 6 couples to a drive unit that rotates the transport element 6 about a vertical machine axis MA of its machine unit 3.1-3.*n*. The particular embodiment shown features eight machine units 3.1-3.8, each of which comprises a transport element 6 that has functional elements necessary for its particular task.

Each transport element 6 is preferably configured such that numerous identical treatment segments 20, also referred to as "treatment modules," can be attached to the circumference thereof. These treatment segments 20 impart a specific functionality to their corresponding machine units 3.1-3.8 for a specific functionality. Examples of treatment segments 20 include pre-treatment segments, which are configured for sterilizing containers, printing segments, which are configured for ink-jet printing on the containers, and post-treatment segments, such as curing units for drying the printed image, and inspection units for inspecting the print quality.

Each treatment segment 20 includes a mechanism for retaining and releasing a retention-and-centering unit 10, that is configured for retaining and centering a container 2 that is to be printed upon. In particular, each treatment segment 20 incudes a receiver to which a retention-and-centering unit 10 can be attached and from which it can easily be detached. As a result, the container 2 maintains its relation to a treatment segment 20 during movement of the transport element 6. In addition, the container 2 remains associated with and held by its retention-and-centering element 10 throughout the treatment process.

The transport elements 6 of the individual machine-units 3.1-3.8 are disposed such that they directly adjoin one another. In addition, adjacent transport elements 6 are rotated synchronously in opposite directions, thus forming the serpentine transport-pathway TW, with its numerous turns as shown in FIGS. 2*a* and 2*b*, between the container intake 1.1 and the container discharge 1.2. The individual containers 2 are conveyed directly from the transport element 6 of a machine unit 3.1-3.7 to the transport element 6 of the subsequent machine unit 3.2-3.8 in the transport direction A.

The first machine-unit 3.1 forms the intake unit for the printing machine 1. In some embodiments, the first machine unit 3.1 pre-treats the container 2 at least in a region that is to be printed upon. Examples of such pre-treatment include a plasma treatment and corona treatment. This is particularly useful when subsequent machine units carry out inkjet printing or tone-jet printing.

The second through sixth machine-units 3.2-3.6 are the actual printer units. Each one has numerous printing stations disposed around its circumference. These are where printing takes place. Each of the second through sixth machine units 3.2-3.6 prints one color. In particular, each machine unit 3.2-3.6 prints a color selected from the group consisting of white, yellow, magenta, cyan and black.

The seventh machine-unit 3.7 is a drying unit that dries or cures the inks applied in the preceding machine units. In a typical embodiment, this is carried out through energy input, with energy typically in the form of heat and/or UV radiation.

The eighth machine-unit 3.8 forms the container discharge 1.2 through which the printed containers 2 exit the printing machine 1. In some embodiments, the eighth machine unit 3.8 is configured as a drying module.

Further machine units could be provided along the chain of machine units 3.1-3.8, an example being an inspection unit. Additionally, certain machine units could be omitted, in order to adapt the printing machine 1 to specific needs.

As is shown in FIG. 2*b*, the containers 2 move with the transport elements 6 of the first and eighth machine-units 3.1, 3.8 over an angular range of approximately 90° about the vertical machine-axes MA. They move over an angular range of 180° about the vertical machine axes MA of the second through seventh machine-units 3.2-3.7.

Each machine unit 3.1-3.*n* has treatment units formed as treatment modules or treatment segments 20. These treatment segments 20 are mounted such that they can be swapped in and out of the machine unit 3.1-3.*n*. As such, each treatment segment 20 is a completely functional component or module on the transport elements 6 of the respective machine units 3.1-3.*n* that is driven to rotate about the respective vertical machine axes MA.

The transport elements 6 can be driven continuously or intermittently. The treatment segments 20 are provided on the circumference of the transport element 6. When viewed from above, the treatment segments 20 are arranged like slices of a pie or wedges. As such, the treatment segments 20 define a continuous ring.

Each retention-and-centering unit 10 retains and centers a container 2 and also rotates or pivots the container. In particular, each retention-and-centering unit 10 aligns the container along its vertical container axis and rotates it around its vertical container axis during treatment or printing on the container 2.

In an alternative embodiment, instead of having the retention-and-centering unit 10 be detachable from the treatment segment 20, the retention-and-centering unit 10 is with its treatment segment 20. In such embodiments, the retention-and-centering unit 10 cannot be exchanged between the treatment segments 20.

To promote a more precise transfer of the retention-and-centering units 10 from one transport element 6 to a subsequent transport element, it is necessary that the transport elements be aligned as precisely as possible to one another and that the treatment segments 20 be secured as precisely as possible on the transport elements 6.

FIG. 3 shows a treatment segment 20 placed on a transport element 6. A coupling section 21 on the back surface of the treatment segment 20 secures the treatment segment 20 against movement relative to the transport element 6 along three orthogonal spatial axes. The coupling section 21 is thus opposite the front section where the print-head is located.

The coupling section 21 has a first coupling-element 22 that secures the upper region of the treatment segment 20. In many embodiments, the first coupling-element 22 is provided in the upper half or the treatment segment 20. In many other embodiments, the first coupling-element 22 is located in the upper third, of the treatment segment 20.

The first coupling-element 22 is configured to interact with an upper support-rim 6.1 that functions as a first support-section provided on the transport element 6. In particular, two spaced-apart bearing sections on the first coupling-element 22 bear on the upper support-rim 6.1. These bearing sections promote precise positioning of the treatment segment 20 on the transport element 6.

The first support-section of the transport element 6 has at least two spaced-apart planar bearing-regions in a coupling region in which a treatment segment 20 can be attached. These bearing regions lie in a horizontal plane, which corresponds to the x-z plane in the coordinate system shown in the figure. The bearing sections 22.1 of the treatment segment 20 bear on the top thereof opposite the bearing regions. The first support-section of the transport element 6 has two spaced-apart bearing regions in the coupling region. These run perpendicular to the x-axis. The bearing sections of the first coupling-element 22 bear opposite to these bearing regions.

The upper support-rim 6.1 forms the first support-section. A radial outer portion of the upper support-rim 6.1 forms circumferential first and second bearing-region 6.1.1, 6.1.2. The first bearing-region is planar and faces axially upwards. The second bearing region 6.1.2 is on the front surface and faces radially outward.

The upper support-rim 6.1 has a polygonal circumference. This creates flat surfaces at the coupling regions. As a result, an edge can be created from two surfaces that form an angle, such as a right angle. It is to such an edge that the treatment segment 20 attaches in a precise position.

The upper support-rim 6.1 is a high-precision component having tolerances in a range of ±0.01 mm to ±0.05 mm, in particular 0.02 mm, 0.03 mm or 0.04 mm. The first coupling-element 22 can also be a high-precision component having tolerances of only a few micrometers.

As can be seen in FIG. 3, the first coupling-element 22 extends radially inward from the back surface of the treatment segment 20 into the interior of the treatment segment 20. In particular, the first coupling-element 22 is formed from a solid and flat piece of metal that extends along a plane that is parallel to the x-z plane.

A weld establishes a permanent connection between a component carrier 23 in the interior of the treatment and the first coupling-element 22. The component carrier 23 protrudes downward from the first coupling-element 22 in a direction that is parallel to the y-axis. The component carrier 23 is likewise a high-precision part that is formed from a solid piece of flat metal. Numerous receivers or openings 23.1 on the component carrier 23 provide places to attach equipment, such as a print head or a curing apparatus.

Preferably, the first coupling-element 22 protrudes from both the back surface as well as the front surface of the component carrier 23 and in the x-direction in accordance with FIG. 3 such that the receiver 11 for the retention-and-centering unit 10 can be secured on the front projection thereof lying opposite the bearing section of the first coupling-element 22. In some embodiments, the receiver 11 attaches directly to the undersurface of the first coupling-element 22. As a result, impacts resulting from the insertion of the retention-and-centering unit 10 into the receiver 11 are transferred directly to the first coupling-element 22. This effectively prevents vibrations in the treatment segment 20.

Referring still to FIG. 3, a second coupling-element 24 on the component carrier 23 is spaced-apart from the first coupling-element 22. A suitable place for the second coupling-element 24 is in the lower half of the treatment segment 20. The second coupling-element 24 protrudes from the back surface of the component carrier 23 and interacts with a second support-section of the transport element 6 to secure the treatment segment 20 on the transport element 6. The second support-section lies below the first support-section along the axis of the transport element 6. The second support-section can be likewise designed as a lower support-rim 6.2 that runs along the circumference of the transport element 6. The connection of the treatment segment 20 to the first, and potentially, second support-sections can take place through hanging the coupling section 21 in the support section(s), as described in greater detail below.

Figure 4:
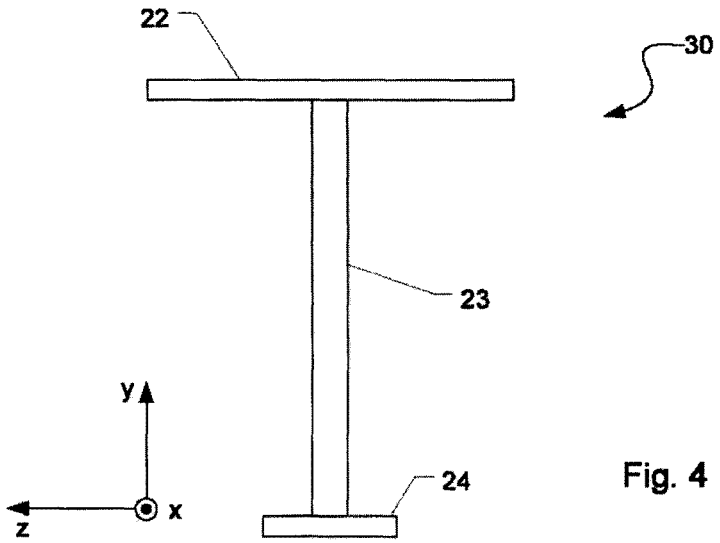
FIG. 4 shows a front view of a support structure for the treatment segment shown in FIG. 3.

FIG. 4 shows a front view of a support structure 30 comprising the first and second coupling-elements 22, 24 and the component carrier 23 running between them. This support structure 30 forms the fundamental structure of the treatment segment 20. All of the components, e.g. the equipment (print head, etc.), the receiver 11 for the retention-and-centering unit 10, as well as the housing 25, attached, at least indirectly, to the support structure 30.

The support structure 30 preferably has a double T-shaped design. Through the reduction of the components forming the support structure, a high-precision attachment of the treatment segments 20 to the transport element can be obtained with low production costs.

Figure 5:
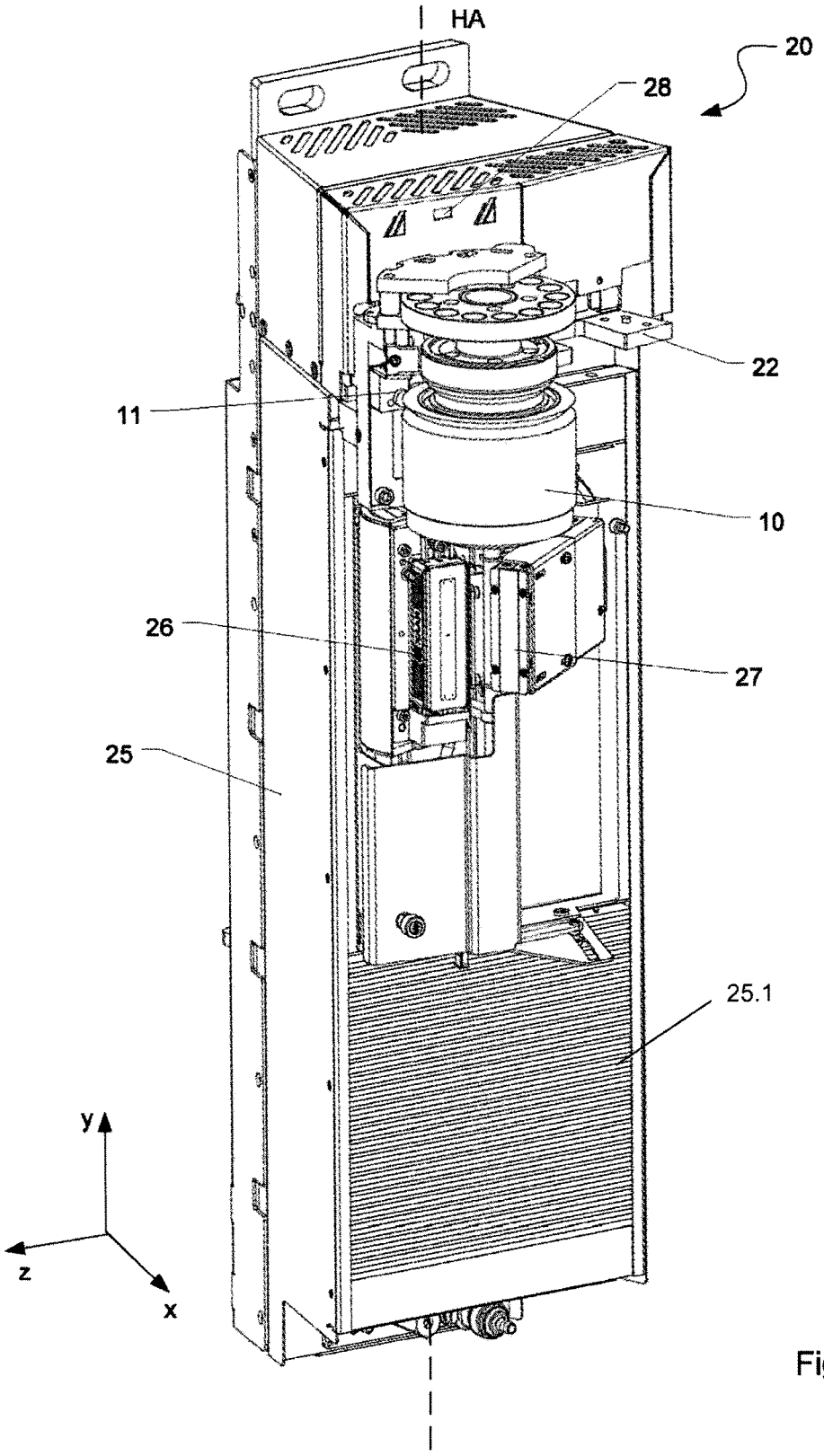
FIG. 5 shows a perspective view of the front of a treatment segment for the printer shown in FIG. 1.
Figure 6:
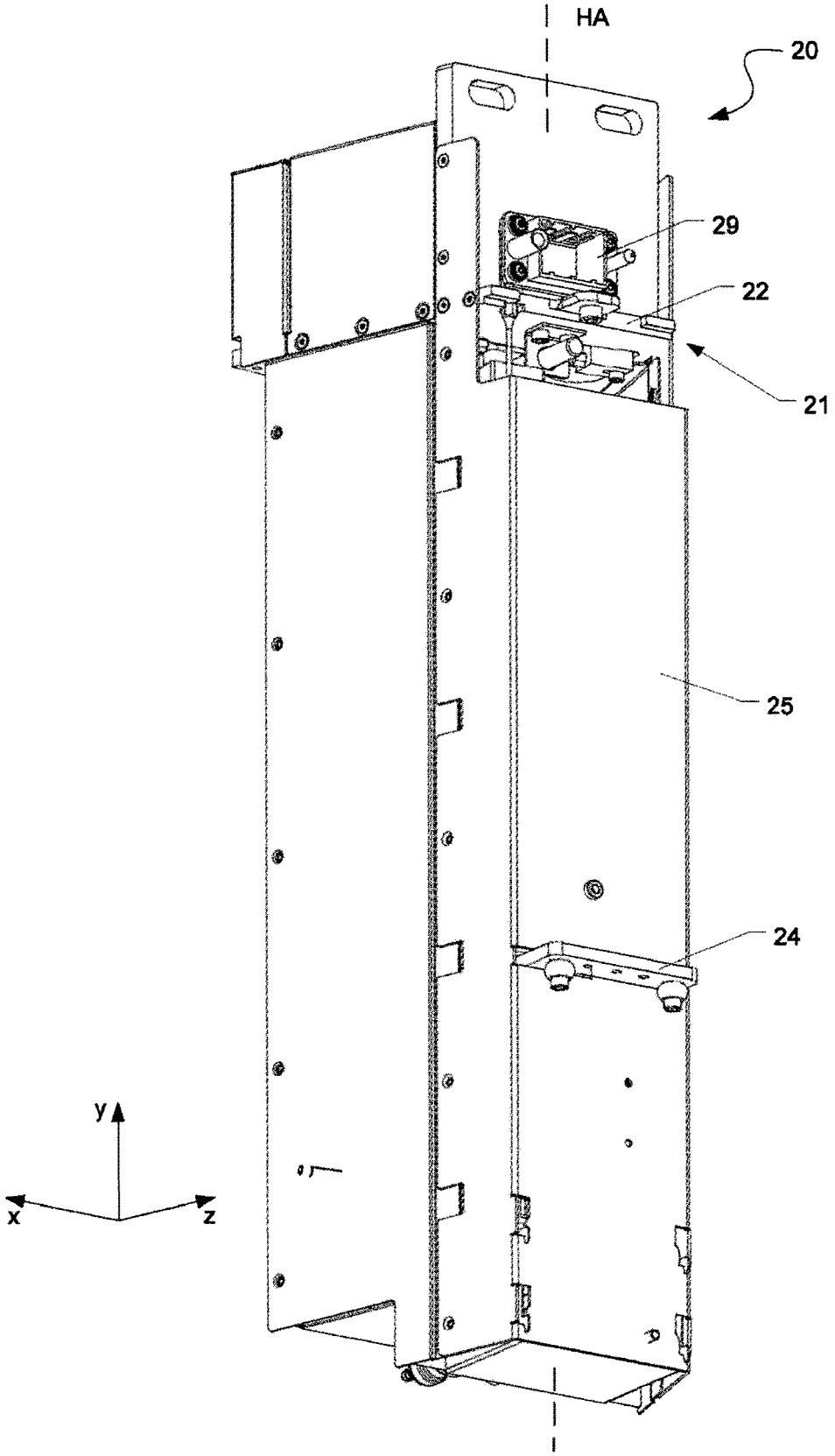
FIG. 6 shows a perspective view of the rear a treatment segment shown in FIG. 5.

FIGS. 5 and 6 show front and rear views of a treatment segment 20. In this example, the treatment segment 20 is a printing segment.

The treatment segment 20 has a housing 25 surrounding the support structure 30 in or on which all of the functional components necessary for container printing are provided. By way of example, a print head 26, a curing device 27, and the receiver 11 for the retention-and-centering unit 10 are provided thereon.

A near-field communication interface 28 on the treatment segment 20 interfaces with a wireless communication network for exchanging data between treatment segments 20. Examples of a near-field communication interface include a WLAN interface, a Bluetooth interface, and an infrared interface.

In some embodiments, the housing 25 has an adjustable louver 25.1 for closing off a receiving region for equipment. As a result, it is possible to close off a region that is not populated with equipment by closing the louver 25.1. This eliminates sources of air turbulence, such as chambers or hollow spaces.

As can be seen in FIG. 6, a connecting region 29 on the back surface of the treatment segment 20 corresponds to a connecting region in the region of the transport element 6. The connecting region 29 is a plug-in connection. The connecting region 29 can be used to transfer any combination of electrical energy, control data and printing ink between treatment segments 20. Preferably, a connecting region 29 formed by a plug-in connection is directly above the first coupling-element 22 on the housing 25.

Figure 7:
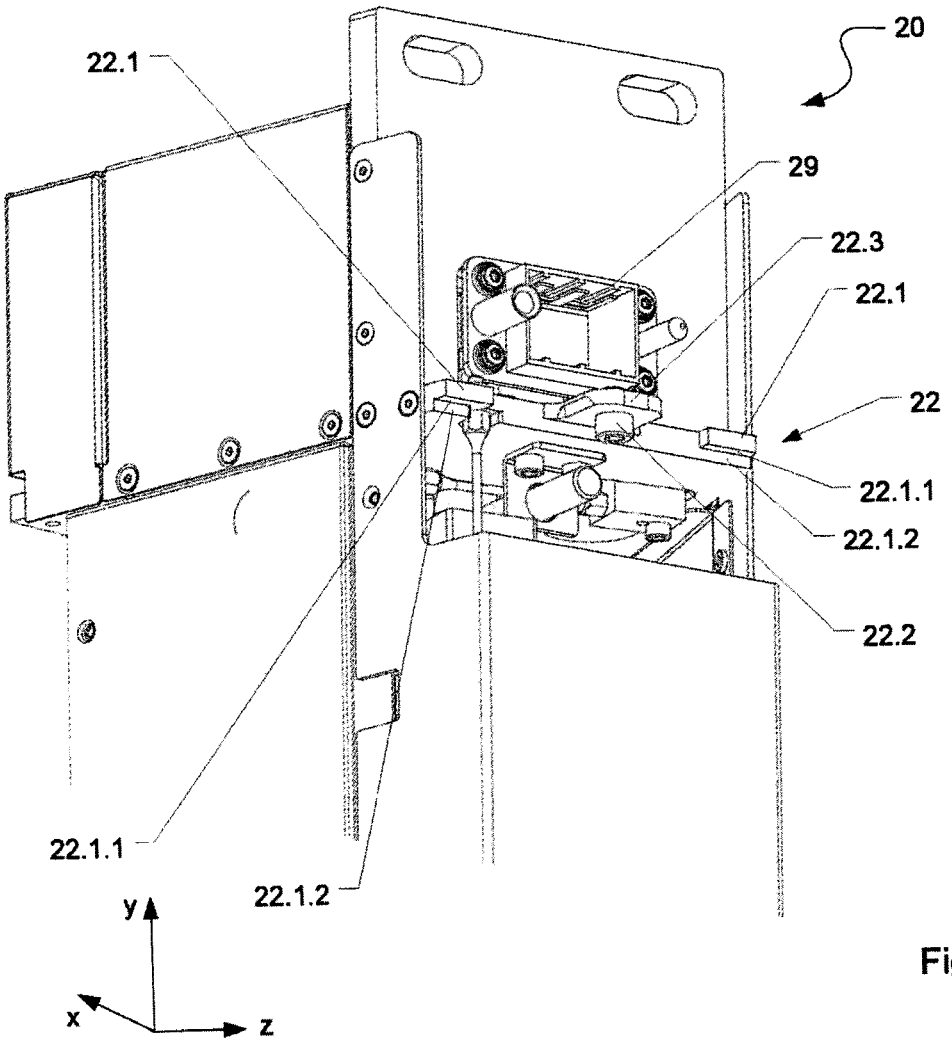
FIG. 7 shows a perspective view of an upper, rear coupling section of the treatment segment shown in FIG. 5.
Figure 8:
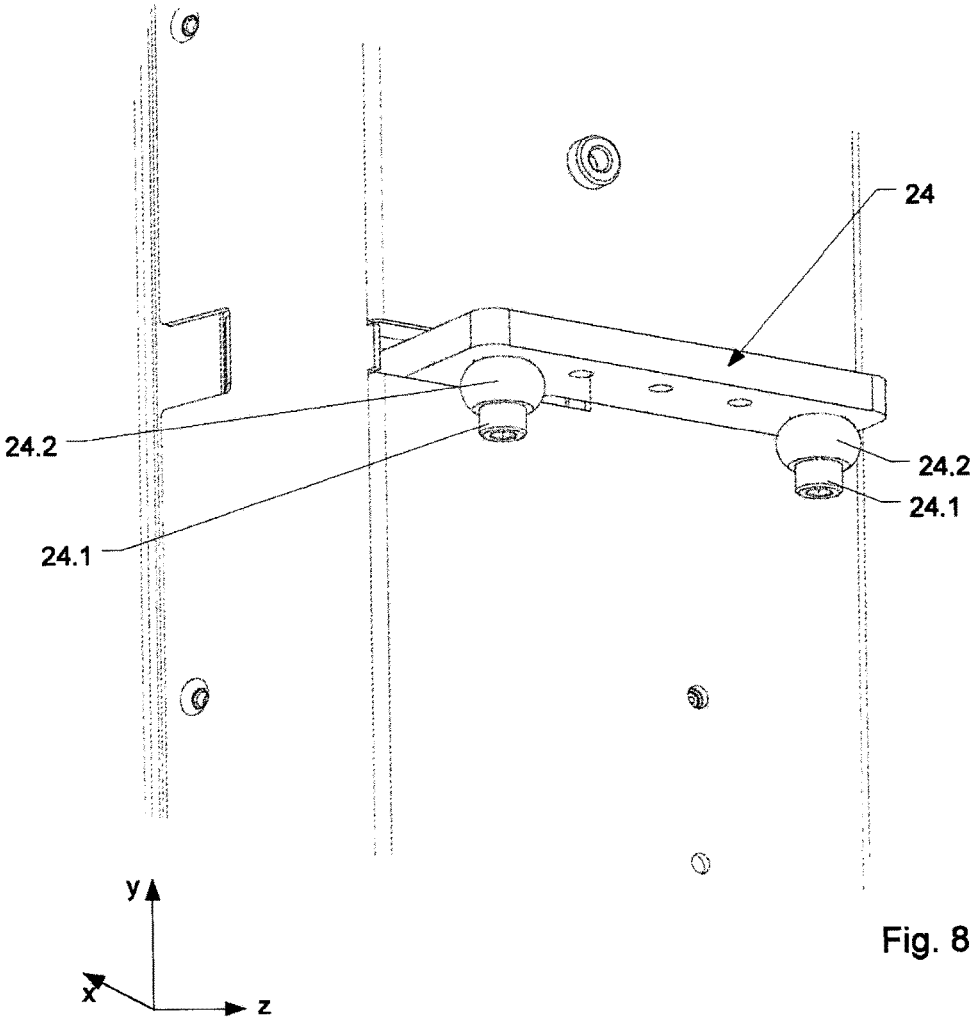
FIG. 8 shows a perspective view of a lower-rear coupling-section of the treatment segment shown in FIG. 5.

FIGS. 7 and 8 show an enlarged view of the coupling region provided on the back surface of the treatment segment 20. Two spaced-apart bearing sections 22.1 are provided on the first coupling-element 22. These bearing surfaces 22.1 are preferably angular and form pairs of bearing surfaces 22.1.1, 22.1.2.

The first bearing-surface 22.1.1 is preferably a planar bearing-surface that is oriented parallel to an x-z plane. The respective bearing section 22.1 bears on the top surface of the upper bearing region 6.1.1 of the upper support-rim 6.1 with the first bearing surface 22.1.1.

The second bearing-surface 22.1.2 of the bearing section 22.1 is perpendicular to the first bearing-surface 22.1.1, and is disposed below the first bearing-surface 22.1.1. The second bearing-surface 22.1.2 is configured to bear against the front-surface bearing-region 6.1.2 of the upper support-rim 6.1, i.e. it bears on the front surface of the upper support-rim 6.1. This second bearing-surface 22.1.2 can either be planar, if the upper support-rim 6.1 has a flat front-surface), or it can have a concave curvature that is adapted to the convex curvature of the upper support-rim 6.1. As a result, the bearing sections 22.1 encompass an upper edge of the upper support-rim 6.1, in a form-fitting manner such that precise positioning of the treatment segment 20 on the transport element 6 takes place through the bearing sections 22.1 in a defined x-y position.

A connecting section 22.2 between the two bearing sections 22.1 secures the treatment segment 20 to the transport element 6 at a defined z-position. The connecting section 22.2 can be configured in the manner of a bolt that can be inserted into an opening in the upper support-rim 6.1 and that corresponds to the connecting section 22.2. The connecting section 22.2 can be retained on an attachment section 22.3 that protrudes from the back surface of the first coupling-element and can be spaced apart therefrom at the undersurface thereof. The attachment section 22.3 and the bearing sections 22.1 can be formed by milling the first coupling-element 22.

Screwing to the upper support-rim 6.1 can take place through the connecting section 22.2 such that inserting the treatment segment 20 into the upper support-rim 6.1, for example by hanging, prevents undesired release of the treatment segment 20 from the transport element 6.

FIG. 8 shows the lower coupling region of the treatment segment 20, which interacts with the lower support-rim 6.2. At least one downward protruding, bolt-like connecting section 24.1 is provided on a region of the second coupling-element 24 protruding toward the back with respect to the housing 25. Preferably, a pair of bolt-like connecting sections 24.1 are provided, which are spaced apart to one another in a transverse direction running perpendicular to the vertical axis HA of the treatment segment 20 (along the z-axis). Corresponding boreholes are provided in the lower support-rim 6.2 at the coupling regions, to which a treatment segment 20 can be attached, into which holes, the bolt-like connecting sections 24.1 can be placed. In greater detail, the bolt-like connecting sections 24.1 are placed above these boreholes, and subsequently inserted into the boreholes of the lower support-rim 6.2 through a vertical pushing movement. In other words, the treatment segment 20 is hung on the upper and lower support-rims 6.1, 6.2 of the transport element 6 by the bolt-like connecting sections 22.2, 24.1.

Damping elements 24.2 are preferably provided on the bolt-like connecting sections 24.1 provided on the second coupling-element 24, by means of which vibrations or impacts can be dampened. The damping elements 24.2 can encompass the circumference of the bolt-like connecting sections 24.1, in particular such that end regions of the bolt-like connecting sections 24.1 extend downward beyond the damping elements 24.2. These end regions of the bolt-like connecting sections 24.1 can be pushed into the boreholes of the lower support-rim 6.2, such that the damping elements 24.2 each lie on top of the lower support-rim 6.2. As a result, the damping elements 24.2 are provided between the second coupling-element 24 and the lower support-rim 6.2, and can thus dampen, in particular, vertical impacts or vibrations (parallel to the y-axis). The treatment segment 20 can preferably also be screwed to the lower support-rim 6.2 in the region of the second coupling-element 24, in particular in the region of the bolt-like connecting section 24.1, in order to secure the treatment segment 20 against undesired releasing form the transport element 6.

The invention is described above based on exemplary embodiments. It is understood that numerous modifications or alterations are possible, without abandoning the fundamental inventive idea of the invention.

The invention claimed is:

1. A treatment segment for printing on containers, said treatment segment comprising a coupling section for securing said treatment segment on a revolving and drivable transport element such that said treatment segment can be exchanged, wherein said treatment segment comprises at least one of a retention-and-centering unit for securing a container on said treatment segment and a receiver for retaining and releasing a retention-and-centering unit, wherein said coupling section is a component of a support structure that runs, at least in sections, in an interior of said treatment segment enclosed by a housing, and wherein said housing is retained, at least indirectly, on said support structure, wherein said support structure comprises at least one first coupling-element on which at least two spaced apart bearing sections are formed, wherein said bearing sections each have pairs of bearing surfaces that are configured such that an alignment of said treatment segment in relation to the transport element takes place through said bearing surfaces in two orthogonal spatial directions.

2. The treatment segment of claim 1, wherein said bearing sections are angular.

3. The treatment segment of claim 1, wherein said first coupling-element comprises a connecting section provided between said bearing sections.

4. The treatment segment of claim 3, wherein said connecting section is a bolt-like connecting section.

5. The treatment segment of claim 1, wherein said coupling section is configured for hanging retention of said treatment segment.

6. The treatment segment of claim 1, wherein said first coupling-element is formed by a plate-shaped element.

7. The treatment segment of claim 6, wherein said first coupling-element is aligned in said treatment segment such that a vertical axis of said treatment segment is perpendicular to the first coupling-element.

8. The treatment segment of claim 1, wherein said first coupling-element is provided in an upper half of said treatment segment.

9. The treatment segment of claim 1, wherein said first coupling-element is provided in an upper third of said treatment segment.

10. The treatment segment of claim 1, wherein said support structure comprises a component carrier that which protrudes downward form said first coupling-element.

11. The treatment segment of claim 1, further comprising a second coupling-element, wherein said second coupling-element is spaced apart from said first coupling-element.

12. The treatment segment of claim 11, wherein said second coupling-element is connected to said first coupling-element via a component carrier that which protrudes downward form said first coupling-element.

13. The treatment segment of claim 11, wherein said second coupling-element comprises a bolt-like connecting section.

14. The treatment segment of claim 13, further comprising a damping element on said bolt-like connecting section of said second coupling-element.

15. The treatment segment according to claim 1, wherein at least one of said retention-and-centering unit and said receiver is disposed directly on said first coupling-element.

16. A treatment segment for printing on containers, said treatment segment comprising a coupling section for securing said treatment segment on a revolving and drivable transport element such that said treatment segment can be exchanged, wherein said treatment segment comprises at least one of a retention-and-centering unit for securing a container on said treatment segment and a receiver for retaining and releasing a retention-and-centering unit, wherein said coupling section is a component of a support structure that runs, at least in sections, in an interior of said treatment segment enclosed by a housing, and wherein said housing is retained, at least indirectly, on said support structure, wherein said bearing sections each have a planar first bearing surface and a second bearing surface protruding downward at an angle therefrom.

17. The treatment segment of claim 16, wherein said second bearing-surface is planar.

18. The treatment segment of claim 16, wherein said second bearing-surface has a concave curvature.

19. A treatment segment for printing on containers, said treatment segment comprising a coupling section for securing said treatment segment on a revolving and drivable transport element such that said treatment segment can be exchanged, wherein said treatment segment comprises at least one of a retention-and-centering unit for securing a container on said treatment segment and a receiver for retaining and releasing a retention-and-centering unit, wherein said coupling section is a component of a support structure that runs, at least in sections, in an interior of said treatment segment enclosed by a housing, and wherein said housing is retained, at least indirectly, on said support structure, wherein said housing comprises a louver for at least partially closing off a component-receiving region.

20. A treatment segment for printing on containers, said treatment segment comprising a coupling section for securing said treatment segment on a revolving and drivable transport element such that said treatment segment can be exchanged, wherein said treatment segment comprises at least one of a retention-and-centering unit for securing a container on said treatment segment and a receiver for retaining and releasing a retention-and-centering unit, wherein said coupling section is a component of a support structure that runs, at least in sections, in an interior of said treatment segment enclosed by a housing, and wherein said housing is retained, at least indirectly, on said support structure, further comprising a near-field communication interface for data exchange between treatment segments lying opposite one another at front surfaces thereof.

21. The treatment segment of claim 20, wherein said near-field communication interface comprises an infrared interface.

22. An apparatus for printing on containers, said apparatus comprising a transport element, wherein said transport element comprises a first support rim, wherein said first support rim extends along a circumference of said transport element, wherein said first support rim comprises first and second support surfaces, wherein said transport element is driven to revolve, wherein said transport element is configured to permit printing segments to be secured to said first support rim along said circumference, wherein each of said printing segments comprises a coupling section for securing said treatment segment on said transport element such that said treatment segment can be exchanged, wherein each of said printing segments comprises at least one of a retention-and-centering unit for securing a container on said treatment segment and a receiver for retaining and releasing a retention-and-centering unit, wherein said coupling section is a component of a support structure that runs, at least in sections, in an interior of said treatment segment enclosed by a housing, and wherein said housing is retained, at least indirectly, on said support structure, wherein said first support rim comprises support surfaces that make an angle relative to each other, and wherein bearing sections of said printing segments bear against said support surfaces such that said printing segments are disposed precisely in relation to said transport element.

23. The apparatus of claim 22, wherein said support surfaces are orthogonal to each other.

24. The apparatus of claim 22, wherein said support surfaces comprise an upper support rim surface and a front side support rim surface.

25. The apparatus of claim 22, wherein said first support rim is configured for hanging retention of said printing segment.

26. The apparatus of claim 22, further comprising a second support rim on said transport element, wherein said first and second support rims are provided spaced apart from one another along a vertical direction.

27. The apparatus of claim 22, wherein said first support rim comprises boreholes for receiving bolt-like connecting sections provided on said printing segments.

28. The apparatus of claim 22, wherein said first support rim has a polygonal outer circumference.

* * * * *